US011537077B2

(12) United States Patent
Tosuji et al.

(10) Patent No.: US 11,537,077 B2
(45) Date of Patent: Dec. 27, 2022

(54) SHEET TRANSPORT DEVICE AND IMAGE FORMING APPARATUS

(71) Applicant: Brother Kogyo Kabushiki Kaisha, Nagoya (JP)

(72) Inventors: Kenta Tosuji, Nagoya (JP); Yuichiro Ichinose, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 319 days.

(21) Appl. No.: 16/779,869

(22) Filed: Feb. 3, 2020

(65) Prior Publication Data

US 2020/0249613 A1 Aug. 6, 2020

(30) Foreign Application Priority Data

Feb. 4, 2019 (JP) ..... JP2019-017578

(51) Int. Cl.

| | |
|---|---|
| ***B65H 9/16*** | (2006.01) |
| ***B65H 85/00*** | (2006.01) |
| ***B65H 5/36*** | (2006.01) |
| ***G03G 15/00*** | (2006.01) |
| ***B65H 5/06*** | (2006.01) |
| ***B65H 9/00*** | (2006.01) |

(52) U.S. Cl.

CPC ..... *G03G 15/6567* (2013.01); *B65H 5/062* (2013.01); *B65H 5/36* (2013.01); *B65H 9/002* (2013.01); *B65H 9/166* (2013.01); *B65H 85/00* (2013.01); *B65H 2553/61* (2013.01)

(58) Field of Classification Search

CPC .... B65H 5/36; B65H 2553/612; B65H 85/00; B65H 9/166; G03G 15/6567

See application file for complete search history.

(56) References Cited

U.S. PATENT DOCUMENTS

| | | | | |
|---|---|---|---|---|
| 8,899,578 | B2 * | 12/2014 | Tomatsu | G03G 21/1638 271/186 |
| 9,382,083 | B2 * | 7/2016 | Hyodo | B65H 5/36 |
| 10,207,884 | B2 | 2/2019 | Kamikawa et al. | |
| 10,370,210 | B2 * | 8/2019 | Morita | B65H 3/06 |
| 10,450,156 | B2 * | 10/2019 | Mizuno | G03G 15/55 |
| 10,662,014 | B2 * | 5/2020 | Yin | B65H 7/00 |
| 10,800,623 | B2 * | 10/2020 | Kamikawa | G03G 15/234 |

(Continued)

FOREIGN PATENT DOCUMENTS

JP 2018-172215 A 11/2018

*Primary Examiner* — Patrick Cicchino

(74) *Attorney, Agent, or Firm* — Banner & Witcoff, Ltd.

(57) ABSTRACT

A sheet transport device includes a transport guide for guiding, along its transport surface, a sheet in a transport direction, a first transport roller pair, a second transport roller pair, a skew roller pair, a reference wall, and an actuator. The skew roller pair alone transports, in a skewed manner toward an end of the transport surface in a width direction orthogonal to the transport direction, the sheet spaced from the first transport roller and the second transport roller. The reference wall is positioned at the end of the transport surface in the width direction and extends along the transport direction. The actuator is disposed downstream of the skew roller pair and upstream of the second transport roller pair in the transport direction and between the end and a center of the transport surface in the width direction.

8 Claims, 7 Drawing Sheets

(56) References Cited

U.S. PATENT DOCUMENTS

| | | | | |
|---|---|---|---|---|
| 2010/0158596 | A1* | 6/2010 | Inoue | B65H 5/062 399/401 |
| 2018/0282092 | A1 | 10/2018 | Kamikawa et al. | |
| 2020/0247641 | A1* | 8/2020 | Inoue | B65H 1/266 |
| 2020/0249612 | A1* | 8/2020 | Tosuji | G03G 15/6567 |
| 2022/0026838 | A1* | 1/2022 | Ichinose | B65H 85/00 |

* cited by examiner

SHEET TRANSPORT DEVICE AND IMAGE FORMING APPARATUS

CROSS-REFERENCE TO RELATED APPLICATION

This application claims priority from Japanese Patent Application No. 2019-017578 filed on Feb. 4, 2019, the content of which is incorporated herein by reference in its entirety.

TECHNICAL FIELD

Aspects of the disclosure relate to a sheet transport device and an image forming apparatus.

BACKGROUND

A known image forming apparatus includes an image forming unit configured to form an image on one side of a sheet and to form an image on the other side of the sheet transported, along a retransport path, back to the image forming unit.

A skew roller pair and a reference guide are disposed on a side of the retransport path in a width direction orthogonal to a transport direction. A first transport roller pair is disposed upstream of the skew roller in the transport direction, and a second transport roller pair is disposed downstream of the skew roller pair in the transport direction. The skew roller pair alone transports in a skewed manner, along the retransport path, the sheet positioned between the first transport roller pair and the second transport roller pair. The sheet is pressed against the reference guide which thus restricts the position of the sheet in the width direction.

SUMMARY

In such a known image forming apparatus, an actuator may be provided downstream of the skew roller pair and upstream of the second transport roller pair in the transport direction to detect the presence or absence of a sheet transported in the retransport path. The actuator is usually disposed at a center in the width direction. In this case, for detection of a sheet, the actuator may be contacted by the sheet nipped by the skew roller pair alone. A reaction force from the actuator pushed by the sheet is likely to impede the sheet from rotating to follow the reference guide. Thus, the reference guide may fail to properly restrict the position of the sheet in the width direction.

Aspects of the disclosure provide a sheet transport device and an image forming apparatus in which a reference guide is allowed to properly restrict the position of a sheet in a width direction while an actuator is prevented from improperly impeding the sheet from rotating to follow the reference guide.

According to one or more aspects of the disclosure, a sheet transport device includes a transport guide configured to guide, along a transport surface thereof, a sheet in a transport direction, a first transport roller pair disposed at the transport guide, a second transport roller pair disposed at the transport guide at a position downstream of the first transport roller in the transport direction, a skew roller pair, a reference wall, and an actuator. The skew roller pair is disposed at the transport guide at a position downstream of the first transport roller pair and upstream of the second transport roller pair in the transport direction. The skew roller pair is configured to alone transport, in a skewed manner toward an end of the transport surface in a width direction orthogonal to the transport direction, the sheet spaced from the first transport roller pair and the second transport roller pair. The reference wall is positioned at the end of the transport surface in the width direction. The actuator is disposed downstream of the skew roller pair and upstream of the second transport roller pair in the transport direction and between the end and a center of the transport surface in the width direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment of the disclosure will be described with reference to the drawings.

Figure 1:
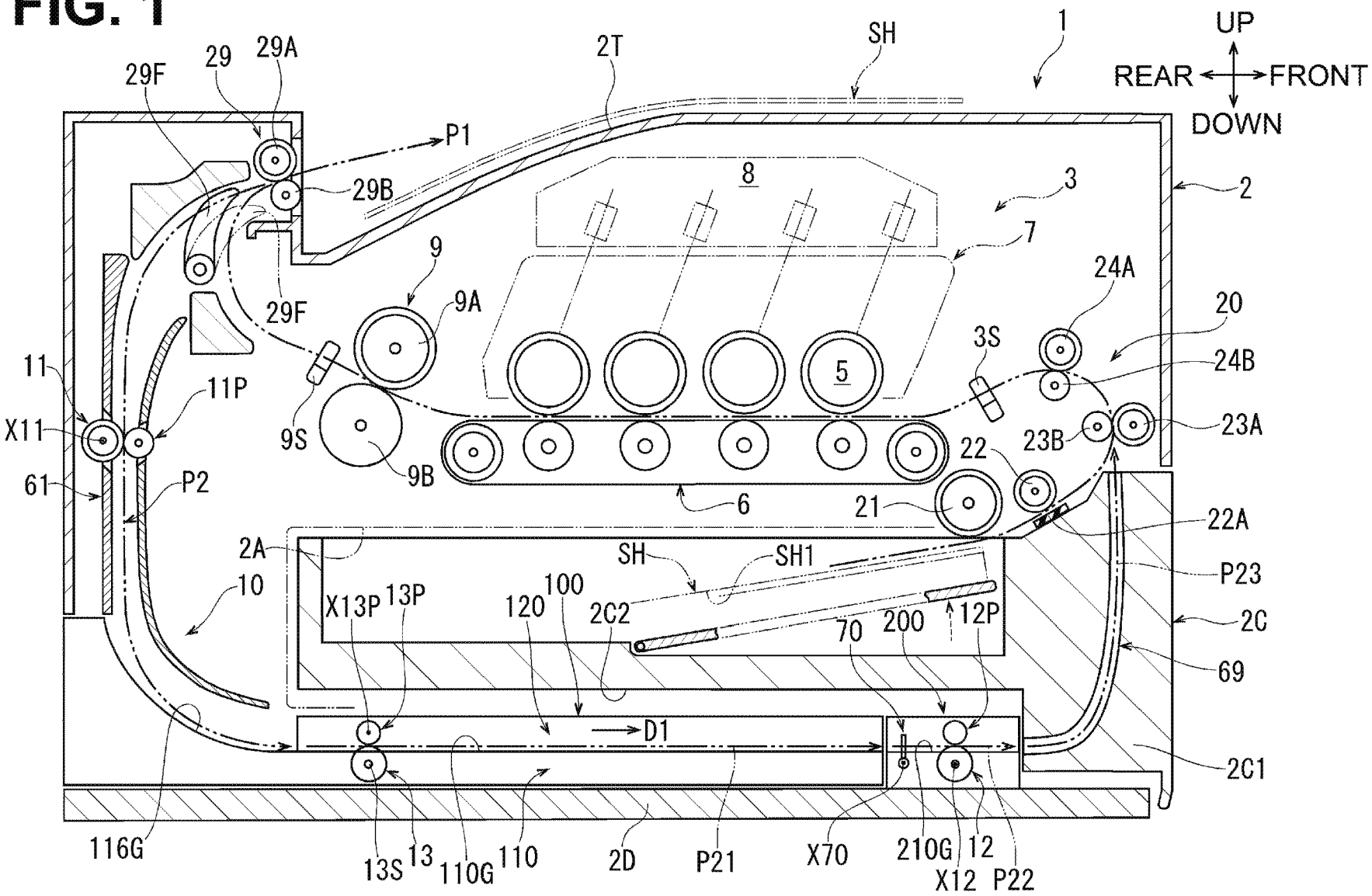
FIG. 1 is a schematic cross-sectional view of an image forming apparatus according to an illustrative embodiment of the disclosure.

FIG. 1 shows an image forming apparatus 1 according to an illustrative embodiment of the disclosure. The image forming apparatus 1 is a color laser printer for electrophotographically forming an image of a plurality of colors on a sheet. The image forming apparatus 1 includes a retransport assembly 10, which is an example of a sheet transport device.

A front-rear direction and an up-down direction are shown in FIG. 1 by defining right and upper sides of the page of FIG. 1 as front and upper sides of the image forming apparatus 1, respectively. A left-hand side of the apparatus 1 when viewed from the front side, i.e., a side facing out of the page of FIG. 1, is defined as a left side of the apparatus 1. A front-rear direction, a left-right direction, and an up-down direction shown in FIG. 2 and subsequent drawings correspond to the directions shown in FIG. 1. Elements of the image forming apparatus 1 will now be described with reference to FIG. 1 and other drawings.

Structures of Main Body, Transfer Path, Feeder, Image Forming Unit, and Discharge Unit As shown in FIG. 1, the image forming apparatus 1 includes a main body 2, a feeder 20, an image forming unit 3, and a discharge unit 29.

The main body 2 includes a housing and an inner frame disposed inside the housing (not shown). The inner frame includes a pair of side frames 90L and 90R schematically shown in FIG. 2. The side frames 90L and 90R are disposed on left and right sides of the main body 2, respectively. The side frames 90L and 90R face each other in the left-right direction and extend in the front-rear direction and in the up-down direction.

As shown in FIG. 1, a sheet tray receptacle 2A is provided in the main body 2. The sheet tray receptacle 2A is an inner space open to a lower portion of the front of the main body 2 and recessed toward the rear of the main body 2.

A sheet tray 2C is attached to the sheet tray receptacle 2A. The sheet tray 2C has a substantially box shape extending substantially horizontally and is open upward. The sheet tray 2C stores therein a stack of sheets SH which undergo image forming. Sheets SH include plain paper sheets, transparent sheets, and cardboard sheets.

A discharge tray 2T is disposed at the top of the main body 2. A sheet SH having an image formed thereon is discharged onto the discharge tray 2T.

The feeder 20, the image forming unit 3, and the discharge unit 29 are disposed inside the main body 2 at a position above the sheet tray receptacle 2A and the sheet tray 2C. The feeder 20, the image forming unit 3, and the discharge unit 29 are assembled to the inner frame (not shown).

Figure 2:
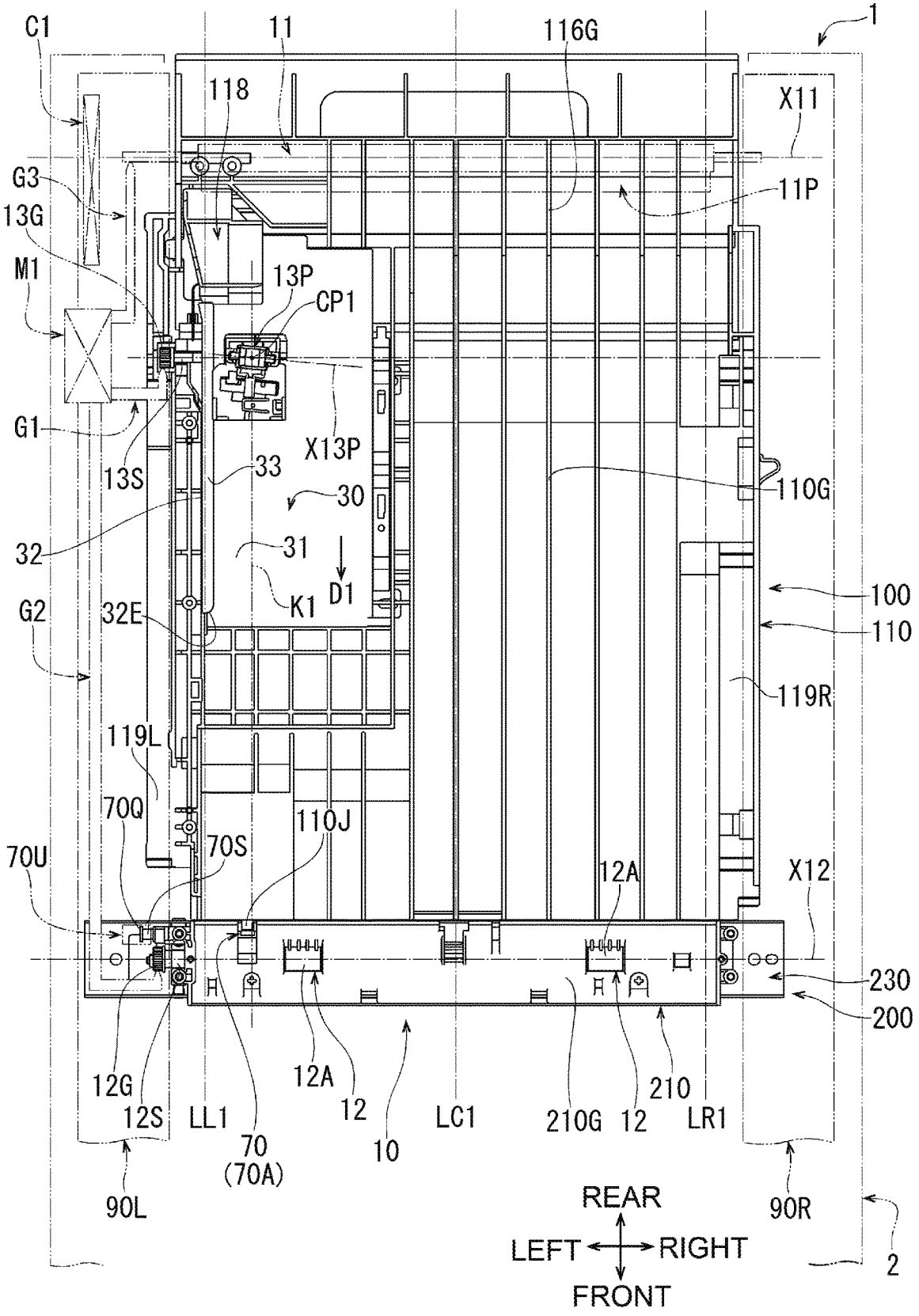
FIG. 2 is a partial top view of the image forming apparatus, mainly showing a main body, a retransport unit from which a cover is removed, and a connecting unit from which an upper beam and a facing member are removed.

As schematically shown in FIG. 2, a controller C1 and a drive source M1 are disposed inside the main body 2. The controller C1 may be a microcomputer including a central processing unit (CPU), a read only memory (ROM), and a random access memory (RAM) which are not shown. The ROM stores therein programs for controlling various operations of the image forming apparatus 1 and programs for identification. The RAM is used as a storage area for temporarily storing data and signals used by the CPU to execute the above-described programs, and a working area for data processing. In this illustrative embodiment, the controller C1 and the drive source M1 are disposed between a left surface of the main body 2 and the left side frame 90L. The feeder 20, the image forming unit 3, and the discharge unit 29 are controlled by the controller C1 and operated upon receipt of a drive force transmitted via a drive force transmitter (not shown).

As shown in FIG. 1, a transport path P1 is defined in the main body 2. The transport path P1 is substantially S-shaped. The transport path P1 extends from a front end of the sheet tray 2C upward to curve in a U shape, extends rearward substantially horizontally, and then extends, at the rear of the main body 2, upward in a U shape to the discharge tray 2T.

In the feeder 20, a feed roller 21 feeds from the sheet tray 2C one sheet SH at a time, separated by a separation roller 22 and a separation pad 22A, to the transport path P1. Then, a transport roller pair 23A and 23B, and a registration roller pair 24A and 24B disposed at the U-shaped portion of the transport path P1 transport the sheet SH toward the image forming unit 3.

A sensor 3S is disposed between the registration roller pair 24A and 24B, and the image forming unit 3. A known optical sensor, such as a photo-interrupter, is used as the sensor 3S to detect an actuator pivoting upon being contacted by a sheet.

When the sensor 3S detects a sheet SH transported by the registration roller pair 24A and 24B, the detection result is transmitted to the controller C1. The controller C1 determines, on the basis of the detection result, a timing when the sheet SH reaches the image forming unit 3 and controls timings for starting and stopping the above-described various elements.

The image forming unit 3 is of the direct tandem type capable of color printing. The image forming unit 3 has a known structure including a process cartridge 7, a transfer belt 6, a scanner 8, and a fixer 9.

The process cartridge 7 is a group of four cartridges corresponding to black, yellow, magenta, and cyan toners and arranged in series or tandem along a substantially horizontal portion of the transport path P1. The four cartridges of the process cartridge 7 each includes, for a corresponding toner color, a photosensitive drum 5, a developing roller (not shown), a charger, and a toner storage.

A transfer belt 6 is disposed below the photosensitive drums 5 to define therebetween the substantially horizontal portion of the transfer path P1. The transfer belt 6 circulates while cooperating with the photosensitive drums 5 to nip a sheet being transported.

A scanner 8 includes laser sources, a polygon mirror, f-theta lenses, and reflecting mirrors. The scanner 8 emits laser beams downward to irradiate respective photosensitive drums 5 in the process cartridge 7.

A fixer 9 is disposed further to the rear than the process cartridge 7. The fixer 9 includes a heat roller 9A positioned on an upper side of the transport path P1, and a pressure roller 9B pressed upward toward the heat roller 9A to define the transport path P1 therebetween. The heat roller 9A and the pressure roller 9B of the fixer 9 heat and press a sheet SH having passed below the process cartridge 7.

A sensor 9S is disposed further to the rear than the heat roller 9A and the pressure roller 9B in the transport path P1. The sensor 9S has the same structure as the sensor 3S.

When the sensor 9S detects a sheet SH transported past the fixer 9, the detection result is transmitted to the controller C1. The controller C1 determines, on the basis of the detection result, a timing when the sheet SH leaves the image forming unit 3 and controls timings for starting and stopping the above-described various elements.

The discharge unit 29 includes a discharge roller 29A, a discharge pinch roller 29B, and a flap 29F. The discharge roller 29A and the discharge pinch roller 29B are positioned most downstream in the transport path P1.

The flap 29F is disposed in the main body 2 at a position further to the rear than and partially lower than the discharge roller 29A and the discharge pinch roller 29B. A lower end of the flap 29F is supported by a frame member (not shown) pivotably between a position shown by a solid line in FIG. 1 and a position shown by a two-dot dashed line in FIG. 1.

The flap 29F is retained by a spring (not shown) at the position shown by the two-dot dashed line in FIG. 1. When a sheet SH is transported along the transport path P1 toward the discharge tray 2T, the flap 29F is pushed by the sheet SH to pivot to the position shown by the solid line in FIG. 1, thereby not interfering with transport of the sheet SH.

The image forming unit 3 forms an image on a sheet SH transported along the transport path P1, as described below. As a photosensitive drum 5 in each of the four cartridges rotates, the surface of the photosensitive drum 5 is uniformly and positively charged by an associated charger, and then the surface of the photosensitive drum 5 is irradiated with a laser beam scanned at high speed by the scanner 8. An electrostatic latent image, which corresponds to an image to be formed on the sheet SH, is formed on the surface of the photosensitive drum 5. Subsequently, toner is supplied from an associated corresponding toner storage onto the surface of the photosensitive drum 5, in accordance with an electrostatic latent image on the photosensitive drum 5. In a state in which a sheet SH is stored in the sheet tray 2C, one side SH1 of the sheet SH faces down. When the sheet SH is transported along the transport path P1 and passes through the image forming unit 3, the one side SH1 of the sheet SH faces up to the photosensitive drums 5. Thus, the toner carried on the surface of the photosensitive drum 5 is transferred onto the one side SH1 of the sheet SH, and the transferred toner is heated and pressed by the fixer 9. Consequently, the transferred toner is fixed onto the sheet SH.

The sheet SH transported past the fixer 9 is pinched by the discharge roller 29A and the discharge pinch roller 29B, and is discharged onto the discharge tray 2T by the discharge roller 29A rotating forward.

Overall Structures of Retransport Path and Retransport Assembly

A retransport path P2 is defined in the main body 2 to allow image forming also on the other side of a sheet SH opposite to the one side SH1. The retransport path P2 extends downward from the discharge unit 29 along a rear surface of the main body 2 and is redirected to extend, below the sheet tray 2C, frontward substantially horizontally. Then, the retransport path P2 is redirected at a position near the front of the main body 2 to extend upward and merge into a position between the separation roller 22 and the transport roller pair 23A and 23B.

A sheet SH is transported along the retransport path P2 in a transport direction D1. The transport direction D1 is changed from downward to frontward to be substantially horizontal, and is further changed to upward. A width direction of a sheet SH transported along the retransport path P2 corresponds to the left-right direction.

The discharge unit 29 also serves as a switch-back mechanism configured to switch back a sheet SH transported along the transport path P1 and to transport the sheet SH into the retransport path P2. Specifically, the controller C1 switches the discharge roller 29A rotating in a forward direction to rotate in a reverse direction at a predetermined timing after the sensor 9S ceases to detect a trailing edge of a sheet SH in the middle of discharging the sheet SH toward the discharge tray 2T by the discharge roller 29A and the discharge pinch roller 29B which pinch the sheet SH therebetween. The predetermined timing is set such that the sheet SH is switched back after the flap 29F pivots to the position shown by the two-dot dashed line in FIG. 1 upon passing of the trailing edge of the sheet SH past the flap 29F. Consequently, the sheet SH is transported toward the retransport path P2 by the discharge roller 29A rotating in the reverse direction, the discharge pinch roller 29B, and the flap 29F located at the position shown by the two-dot dashed line in FIG. 1.

The image forming apparatus 1 includes a retransport assembly 10. The retransport assembly 10 includes a switch-back guide 61 shown in FIGS. 1 and 3, a retransport unit 100 shown in FIGS. 1 through 6 and 8, a connecting unit 200 shown in FIGS. 1 through 5 and 8, and a return guide 69 shown in FIGS. 1 and 3.

The retransport unit 100 is an example of a first unit. The connecting unit 200 is an example of a second unit. The switch-back guide 61, a first guide member 110 (described later) and a cover 120 (described later) of the retransport unit 100, a second guide member 210 (described later) and a facing member 220 (described later) of the connecting unit 200, and the return guide 69 are an example of a transport guide.

In the retransport assembly 10, the switch-back guide 61, the retransport unit 100, the connecting unit 200, and the return guide 69 transport a sheet SH, switched back by the discharge unit 29, back to the image forming unit 3 along the retransport path P2. After the image forming unit 3 forms an image on the other side of the sheet SH opposite to the one side SH1, the sheet SH is discharged onto the discharge tray 2T. A specific structure of the retransport assembly 10 will now be described in detail.

Structures of Switch-Back Guide and First Transport Roller

The switch-back guide 61 defines a portion of the retransport path P2 such that the portion extends downward from the discharge unit 29 along the rear surface of the main body 2. A first transport roller 11 and a pinch roller 11P are disposed at a middle of the switch-back guide 61 in the transport direction D1.

The first transport roller 11 is rotatable about a first axis X11, which is parallel to a width direction orthogonal to the transport direction D1, to transport a sheet SH straight. The pinch roller 11P is pressed against the first transport roller 11. As shown in FIG. 2, the first transport roller 11 and the pinch roller 11P, which hereinafter may be collectively referred to as a first transport roller pair 11 and 11P, are elongated in the left-right direction to have a sufficient length for nipping the sheet SH in the width direction.

The left side frame 90L includes a third transmitter G3. The third transmitter G3, which is only schematically shown, includes a plurality of gears and transmission shafts to transmit a drive force from the drive source M1 to the first transport roller 11. The third transmitter G3 may include a clutch configured to switch between transmission and block of the drive force from the drive source M1.

As shown in FIG. 1, the first transport roller 11 and the pinch roller 11P nip a sheet SH switched back by the discharge unit 29 and transport the sheet SH toward the retransport unit 100.

Structure of Return Guide

The return guide 69 is disposed inside a front end portion of the sheet tray 2C. Specifically, the front end portion of the sheet tray 2C includes an extending portion 2C1. The extending portion 2C1 extends downward beyond a bottom surface 2C2 of the sheet tray 2C to a position near a bottom wall 2D.

An entrance of the return guide 69 is open to a rearward facing surface of the extending portion 2C1. An exit of the return guide 69 is open to an upward facing surface of the front end portion of the sheet tray 2C. The return guide 69 defines, in the retransport path P2, a portion redirected from frontward to upward and extending upward to merge into the transport path P1.

The portion defined by the return guide 69 is a third retransport path portion P23 through which a sheet SH passes inside the return guide 69 frontward and then toward a junction with the transport path P1. An upstream end of the third retransport path portion P23 in the transport direction D1 is located at the extending portion 2C1.

Structures of Retransport Unit, Skew Roller, and Drive Roller

The retransport unit 100 is disposed below the sheet tray 2C and extends horizontally. The retransport unit 100 defines, in the retransport path P2, a curved portion changing the transport direction from downward to frontward, and a portion of a substantially horizontal portion extending frontward. The portion of the substantially horizontal portion defined by the retransport unit 100 is referred to as a first retransport path portion P21.

The retransport unit 100 is movable between a stored position (shown in FIG. 1) at which the retransport unit 100 is stored in the main body 2, and a pulled-out position (shown in FIG. 3) at which the retransport unit 100 is pulled out rearward. In this illustrative embodiment, the retransport unit 100, when at the pulled-out position, is entirely outside the main body 2. Although shown in FIG. 3 as positioned below the image forming apparatus 1, the retransport unit 100 is actually pulled out rearward horizontally.

Pulling out the retransport unit 100 from the stored position to the pulled-out position allows a user to remove any sheet SH jammed in the retransport path P2.

Figure 4:
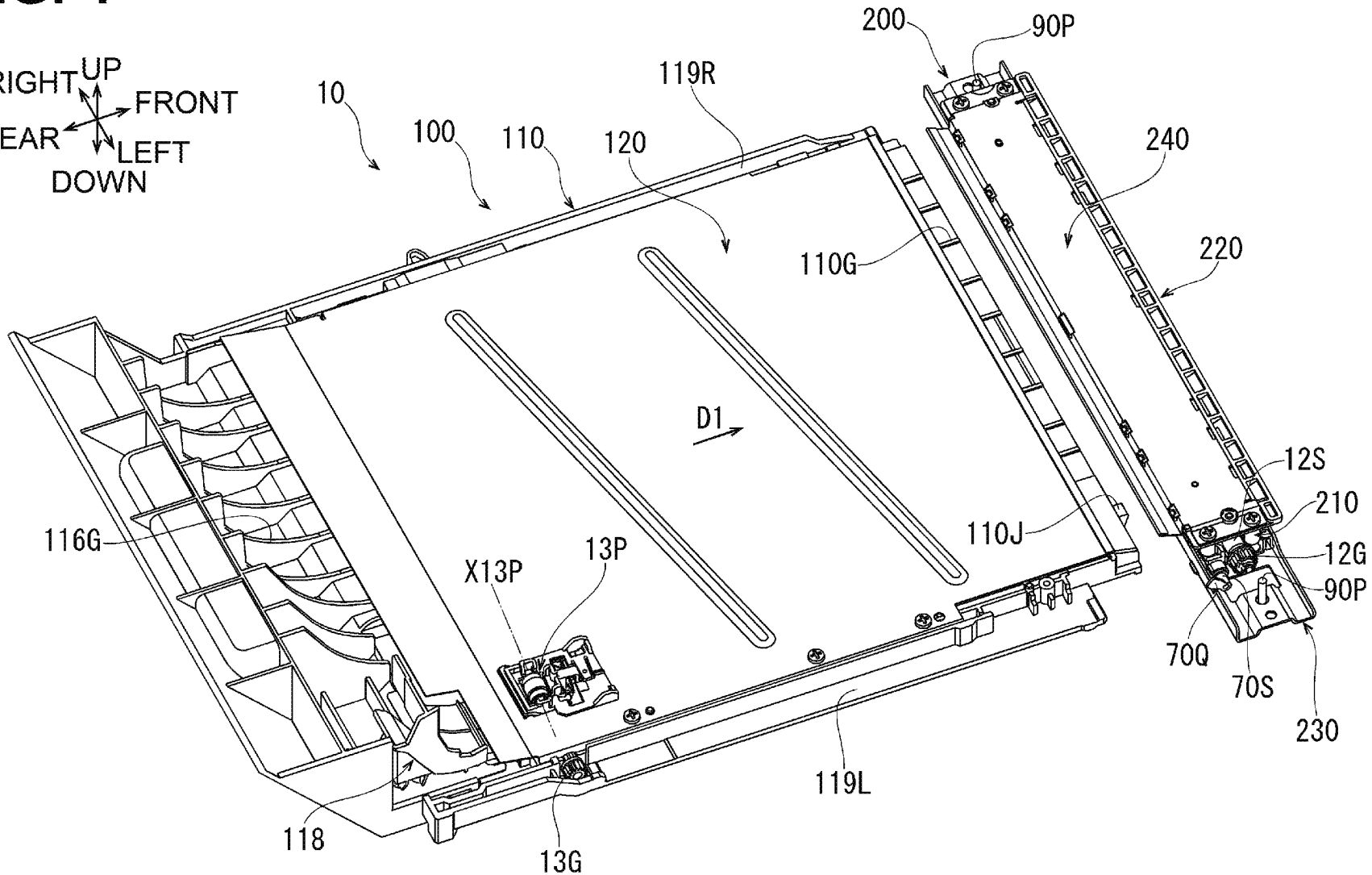
FIG. 4 is a perspective view of the retransport unit and the connecting unit.
Figure 5:
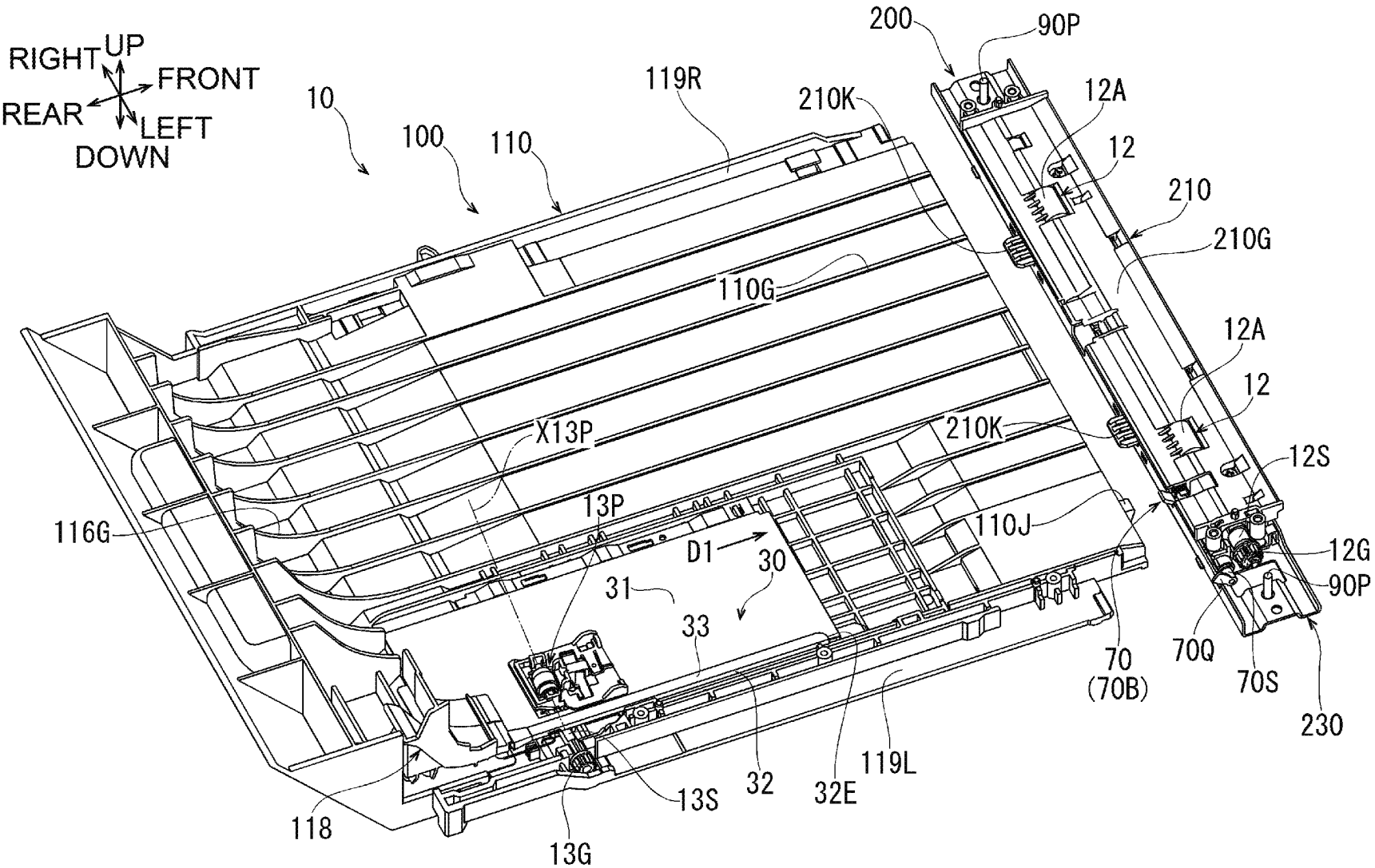
FIG. 5 is a perspective view showing the retransport unit from which the cover is removed, and the connecting unit from which the facing member is removed.

As shown in FIG. 4, the retransport unit 100 includes the first guide member 110 and the cover 120. In FIGS. 2 and 5, the cover 120 is removed from the retransport unit 100.

As shown in FIGS. 2, 4, and 5, the first guide member 110 includes, on its left and right sides, guide ribs 119L and 119R. The guide ribs 119L and 119R extend, in the width direction, beyond the left and right sides of the first guide member 110, respectively.

Figure 3:
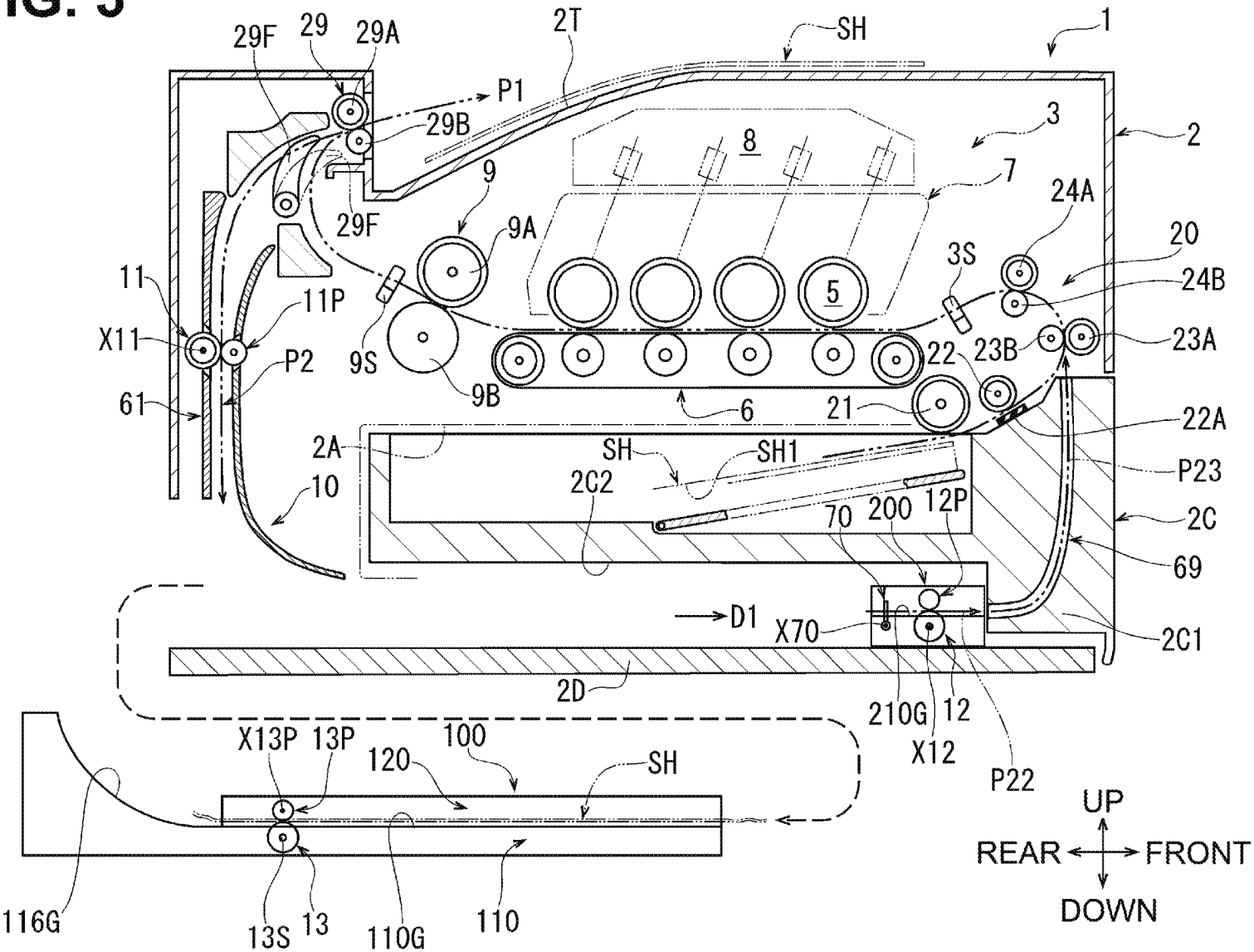
FIG. 3 is a schematic cross-sectional view of the image forming apparatus, showing the retransport unit moved to and located at a pulled-out position.

When the guide ribs 119L and 119R are guided by guide rails (not shown) formed in the side frames 90L and 90R, the retransport unit 100 moves between the stored position (shown in FIG. 1) and the pulled-out position (shown in FIG. 3). The retransport unit 100 shown in FIG. 2 is positioned at the stored position.

As shown in FIGS. 1, 2, and 5, the first guide member 110 includes, on its upper surface, a curved transport surface 116G and a first transport surface 110G.

The curved transport surface 116G is positioned at a rear end of the first guide member 110 and defines the curved portion of the retransport path P2 which changes the transport direction from downward to frontward. The curved transport surface 116G is a curved surface substantially formed by distal ends of a plurality of ribs.

As shown in FIGS. 2 and 5, a side chute 118 is assembled to a left end of the curved transport surface 116G. The side chute 118 guides a left edge of a sheet SH guided on the curved transport surface 116G.

The first transport surface 110G is connected to a downstream end of the curved transport surface 116G in the transport direction D1 and extends substantially horizontally to a front end of the first guide member 110. The first transport surface 110G defines from below the first retransport path portion P21. The first transport surface 110G is a flat surface substantially formed by distal ends of a plurality of ribs.

As shown in FIG. 2, an imaginary line passing through a center of the first transport surface 110G in the width direction and extending in the transport direction D1 is defined as a centerline LC1. An imaginary line extending, at a left end of the first transport surface 110G, in parallel with the centerline LC1 is defined as a left reference line LL1. An imaginary line extending, at a right end of the first transport surface 110G, in parallel with the centerline LC1 is defined as a right reference line LR1.

A distance in the width direction between the left reference line LL1 and the right reference ling LR1 is set to be equal to a length in the width direction of a sheet SH, which is transported on the first transport surface 110G. In the width direction, a distance between the centerline LC1 and the left reference line LL1 is set to be equal to a distance between the centerline LC1 and the right reference ling LR1.

By aligning a left edge of a sheet SH transported on the first transport surface 110G with the left reference line LL1, a center of the sheet SH in the width direction aligns with the centerline LC1. The centerline LC1 also aligns with a center of the image forming unit 3 in the width direction.

As shown in FIGS. 2 and 5, a reference guide 30 is aligned to an end, e.g., to a left end, in the width direction of the first transport surface 110G of the first guide member 110. The reference guide 30, which may be a sheet metal member, is substantially C-shaped in cross section and includes a lower wall 31, a reference wall 32, and an upper wall 33. The reference guide 30 is assembled to the first guide member 110 such that the lower wall 31 is flush with the first transport surface 110G and that the reference wall 32 is positioned on the left reference line LL1 and extends along the transport direction D1.

Figure 8:
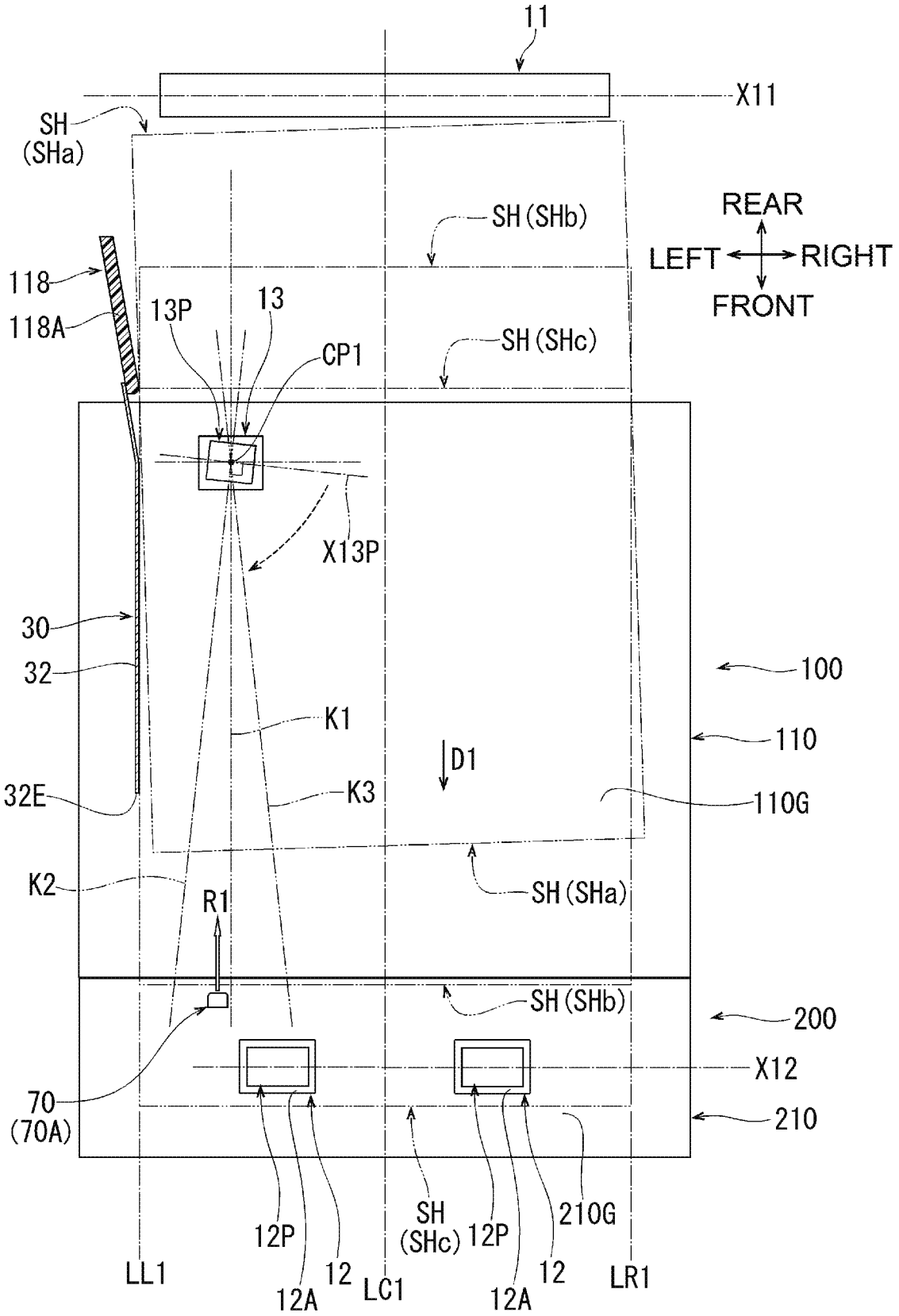
FIG. 8 is a schematic top view of the retransport unit, illustrating how a skew roller and a reference guide act on a sheet.

As shown in FIG. 8, the reference wall 32 of the reference guide 30 is bent at its rear end portion such that a more upstream portion of its rear end portion in the transport direction D1 is offset further to the left from the left reference line LL1. A front end of a side wall 118A of the side chute 118 is adjacent to the right of the rear end of the reference wall 32 and is in contact with the left reference line LL1. The side wall 118A is inclined such that a more upstream portion of the side wall 118A in the transport direction D1 is offset further to the left from the left reference line LL1. A cylindrical pin may be disposed at a front end of the side wall 118A of the side chute 118.

As shown in FIG. 4, the cover 120, which may be a sheet metal member, covers over a substantially entirety of the first transport surface 110G of the first guide member 110. The cover 120 holds, at its rear left end portion, a skew roller 13P.

In FIGS. 2 and 5, the skew roller 13P is shown at the same position as that shown in FIG. 4, and a drive roller 13 shown in FIG. 1 as disposed below the skew roller 13P is invisible. As shown in FIG. 2, the skew roller 13P is rotatable about an axis X13P which is inclined relative to the width direction. The axis X13P is inclined such that a right end of the skew roller 13P is positioned further to the front than a left end of the skew roller 13P. The skew roller 13P is disposed between the centerline LC1 and the left reference line LL1.

As shown in FIG. 1, the drive roller 13 is rotatably supported by the first guide member 110. The drive roller 13 is in contact, from below, with the skew roller 13P to define the first retransport path portion P21 therebetween.

As shown in FIG. 5, a rotation shaft 13S of the drive roller 13 extends in the left-right direction of the drive roller 13 and a left end of the rotation shaft 13S is exposed from a left side of the first guide member 110. A spur gear 13G is fixed to the left end of the rotation shaft 13S.

As shown in FIG. 2, a first transmitter G1 is disposed at the left side frame 90L. The first transmitter G1, which is only schematically shown, includes a plurality of gears and transmission shafts to transmit a drive force from the drive source M1 to the skew roller 13P via the spur gear 13G, the rotation shaft 13S, and the drive roller 13. The first transmitter G1 may include a clutch configured to switch between transmission and block of the drive force from the drive source M1.

The first transmitter G1 includes a spur gear (not shown) which rearwardly meshes with the spur gear 13G. The spur gear 13G leaves the spur gear of the first transmitter G1 when the retransport unit 100 moves from the stored position (shown in FIG. 1) toward the pulled-out position (shown in FIG. 3), and meshes with the spur gear of the first transmitter G1 when the retransport unit 100 moves from the puled-out position toward the stored position.

The skew roller 13P and the drive roller 13, which hereinafter may be collectively referred to as skew roller pair 13, nip, on the first transport surface 110G, a sheet SH transported by the first transport roller 11 and the pinch roller 11P, and transport the sheet SH toward the connecting unit 200. In this case, the skew roller 13P, which rotates about the inclined axis X13P as the drive roller 13 rotates, transports the sheet SH in a skewed manner toward the reference wall 32.

Figure 6:
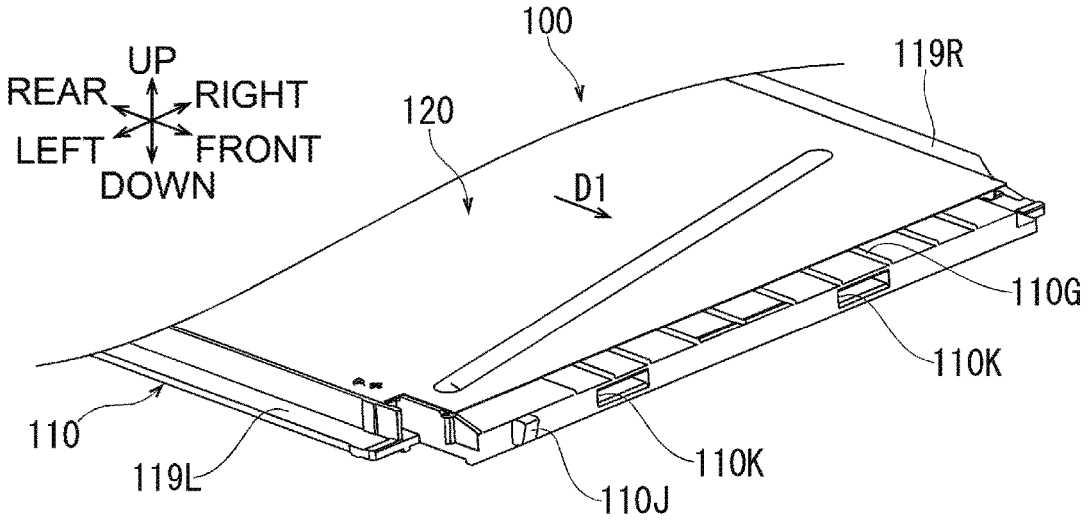
FIG. 6 is a partial perspective view of the retransport unit, showing a positioning recess.

As shown in FIG. 6, the first guide member 110 of the retransport unit 100 has, at its front end face, two positioning recesses 110K. Each positioning recess 110K is a substantially rectangular hole recessed rearward from the front end face of the first guide member 110. The positioning recesses 110K are spaced from each other in the width direction.

The first guide member 110 includes an actuator pusher 110J formed, at a position between a left corner of its front end face and the left positioning recess 110K, to protrude frontward.

Structures of Connecting Unit, Second Transport Roller, and Actuator

As shown in FIG. 1, the connecting unit 200 is disposed below the sheet tray 2C and extends horizontally. The connecting unit 200 is arranged with the retransport unit 100 and the extending portion 2C1 of the sheet tray 2C in the front-rear direction.

The connecting unit 200 defines, in the retransport path P2, a substantially horizontal portion extending frontward. The substantially horizontal portion extending frontward is referred to as a second retransport path portion P22.

The second retransport path portion P22 is connected to a downstream end of the first retransport path portion P21 and to the upstream end of the third retransport path portion P23 in the transport direction D1. In short, the retransport path P2 has the first retransport path portion P21, the second retransport path portion P22, and the third retransport path portion P23 in the transport direction D1.

A substantially horizontal portion of the retransport path P2 is divided into the first retransport path portion P21 and the second retransport path portion P22. Thus, as shown in FIG. 3, the length of the first transport surface 110G in the transport direction D1 is less, to some extent, than the length of a sheet SH in the transport direction D1.

As shown in FIGS. 2, 4, 5, and 7, the connecting unit 200 includes a lower beam 230, a second guide member 210, a facing member 220, and an upper beam 240. The lower beam 230, the second guide member 210, the facing member 220, and the upper beam 240 are connected to each other with fastening screws. The second guide member 210 is an example of a guide member.

The lower beam 230 is disposed at the bottom of the connecting unit 200. The lower beam 230, which may be a sheet metal member, extends in the left-right direction. As shown in FIG. 2, left and right ends of the lower beam 230 are connected to the respective side frames 90L and 90R. As shown in FIG. 5, the left and right ends of the lower beam 230 are positioned by positioning pins 90P which protrude upward from the respective side frames 90L and 90R.

Figure 7:
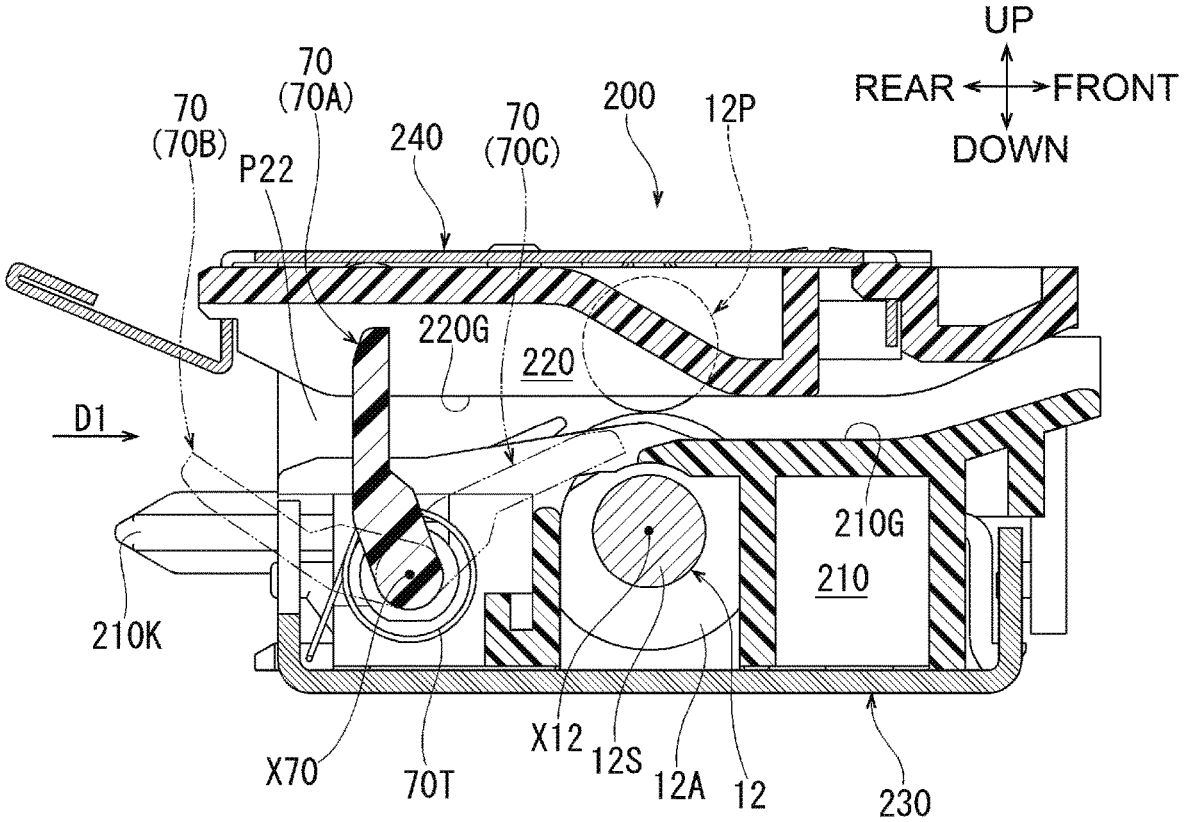
FIG. 7 is a cross-sectional view of the connecting unit.

As shown in FIGS. 5 and 7, the second guide member 210, which may be molded from synthetic resin, is supported from below by the lower beam 230. The second guide member 210 defines, at its upper surface, a second transport surface 210G. The second transport surface 210G extends substantially horizontally from a rear end to a front end of the upper surface of the second guide member 210. The second transport surface 210G defines from below the second retransport path portion P22. As shown in FIG. 2, the centerline LC1 passes through a center of the second transport surface 210G in the width direction.

As shown in FIG. 1, the first transport surface 110G and the second transport surface 210G guide a sheet SH substantially horizontally in the transport direction D1 such that the sheet SH passes the skew roller 13P and reaches a second transport roller 12. The first transport surface 110G and the second transport surface 210G are each an example of a transport surface.

As shown in FIGS. 5 and 7, the second guide member 210 includes two positioning protrusions 210K. Each positioning protrusion 210K protrudes rearward from a rear surface of the second guide member 210 toward the first guide member 110 of the retransport unit 100. The positioning protrusions 210K are arranged to be aligned with corresponding positioning recesses 110K of the first guide member 110 and are spaced from each other in the width direction.

In a state in which the retransport unit 100 is located at the stored position, the positioning protrusions 210K are fitted in the corresponding positioning recesses 110K. In this way, as shown in FIG. 2, the retransport unit 100 is positioned relative to the connecting unit 200 and the main unit 2.

As shown in FIG. 7, the facing member 220, which may be molded from synthetic resin, is disposed above the second guide member 210. The facing member 220 faces the second transport surface 210G with a gap therebetween. The facing member 220 defines, at its lower surface, a guide surface 220G. The guide surface 220G defines from above the second retransport path portion P22.

As shown in FIGS. 4 and 7, the upper beam 240 is disposed at the top of the connecting unit 200. The upper beam 240, which may be a sheet metal member, extends in the left-right direction. The upper beam 240 reinforces from above the facing member 220.

As shown in FIGS. 2, 5, and 7, the second guide member 210 of the connecting unit 200 includes the second transport roller 12. The second transport roller 12 includes a rotation shaft 12S and two roller portions 12A. The rotation shaft 12S has a second axis X12 parallel to the width direction. Each roller portion 12A is fixed to the rotation shaft 12S so as to be integrally rotatable with the rotation shaft 12S.

The second transport roller 12 is rotatable about the second axis X12, with upper ends of the roller portions 12A exposed from the second transport surface 210G. As shown in FIG. 2, the roller portions 12A of the second transport roller 12 are spaced equidistantly from the centerline LC1 in the left-right direction.

As shown in FIG. 7, the facing member 220 of the connecting unit 200 includes two pinch rollers 12P. Each pinch roller 12P is held by the facing member 220, with its lower end exposed from the guide surface 220G. Each pinch roller 12P is pressed toward a corresponding roller portion 12A of the second transport roller 12 by a pressing member (not shown) disposed between the upper beam 240 and the facing member 220.

As shown in FIG. 5, a left end of the rotation shaft 12S is exposed from a left side of the second guide member 210. A spur gear 12G is fixed to the left end of the rotation shaft 12S.

As shown in FIG. 2, a second transmitter G2 is disposed at the left side frame 90L. The second transmitter G2, which is only schematically shown, includes a plurality of gears and transmission shafts to transmit a drive force from the drive source M1 to the roller portions 12A of the second transport roller 12 via the spur gear 12G and the rotation shaft 12S. The second transmitter G2 may include a clutch configured to switch between transmission and block of the drive force from the drive source M1.

The second transport roller 12 and each of the pinch rollers 12P, which hereinafter may be collectively referred to as second transport roller pair 12 and 12P, nip, on the second transport surface 210G, a sheet SH transported in a skewed manner by the skew roller 13P and the drive roller 13, and transport the sheet SH toward the return guide 69 which defines the third retransport path portion P23.

As shown in FIG. 1, the length of a portion of the retransport path P2 from the first transport roller 11 to the second transport roller 12 is set to be greater than the length in the transport direction D1 of a sheet SH to be retransported. This allows the skew roller 13P and the drive roller 13 alone to transport, in a skewed manner, a sheet SH spaced from the first transport roller 11 and the second transport roller 12.

As shown in FIGS. 2, 5, and 7, the second guide member 210 of the connecting unit 200 includes an actuator 70 for detecting whether a sheet SH passing on or over the second transport surface 210G is present. The actuator 70 is disposed at a rear end portion of the second transport surface 210G, and pivotable about a pivot axis X70 parallel to the width direction.

As shown in FIG. 2, the actuator 70 is disposed downstream of the skew roller 13P (the skew roller pair 13 and 13P) and upstream of the second transport roller 12 (the second transport roller pair 12 and 12P) in the transport direction D1. Specifically, a guide end 32E, which is a downstream end of the reference wall 32 of the reference guide 30 in the transport direction D1, is located downstream of the skew roller 13P (the skew roller pair 13 and 13P) and upstream of the second transport roller 12 (the second transport roller pair 12 and 12P) in the transport direction D1. The actuator 70 is located downstream of the guide end 32E in the transport direction D1.

The actuator 70 is disposed between the centerline LC1 and the left reference line LL1. Specifically, as shown in FIG. 5, the actuator 70 is located between a left corner of a rear surface of the second guide member 210 and the left positioning protrusion 210K to correspond to the actuator pusher 110J of the first guide member 110.

The location of the actuator 70 will now be described in a different perspective. As shown in FIG. 8, an imaginary line passing through a midpoint CP1 of the axis X13P of the skew roller 13P and extending in the transport direction D1 is defined as a first imaginary line K1. An imaginary line passing through the midpoint CP1 of the axis X13P of the skew roller 13P and extending orthogonally to the skew axis X13P is defined as a second imaginary line K2. The second imaginary line K2 deviates toward the left reference line LL1 as it extends in the transport direction D1. An imaginary line symmetric to the second imaginary line K2 relative to the first imaginary line K1 is defined as a third imaginary line K3.

The actuator 70 is disposed between the third imaginary line K3 and the left reference line LL1. The actuator 70 is disposed between the first imaginary line K1 and the left reference line LL1.

The actuator 70 thus disposed is used for detection of the presence or absence of a sheet SH transported, by the skew roller pair 13 and 13P alone, between the first transport roller 11 (the first transport roller pair 11 and 11P) and the second transport roller 12 (the second transport roller pair 12 and 12P).

As shown in FIG. 7, the second guide member 210 of the connecting unit 200 includes a torsion coil spring 70T. The torsion coil spring 70T is an example of an urging member. The torsion coil spring 70T exerts an urging force to urge the actuator 70 upstream in the transport direction D1.

The actuator 70 (70A) shown in FIGS. 2, 7, and 8 is located at a first standby position and protrudes upward beyond the second transport surface 210G. As shown in FIG. 7, an upper end of the actuator 70 (70A) at the first standby position is positioned above the guide surface 220G.

The actuator 70 (70B) shown in FIGS. 5 and 7 pivots, due to the urging force of the torsion coil spring 70T, upstream in the transport direction D1 from the first standby position to a second standby position, and is held at the second standby position.

The actuator 70 (70A) shown in FIG. 7 is pressed by a sheet SH passing on or over the second transport surface 210G to move, against the urging force of the torsion coil spring 70T, downstream in the transport direction D1 from the first standby position to a passage allowing position. The actuator 70 (70C) at the passage allowing position is retracted below the second transport surface 210G to allow the sheet SH to pass. The actuator 70 (70C) at the passage allowing position overlaps the roller portions 12A when viewed in the width direction.

As shown in FIG. 2, when the retransport unit 100 moves from the pulled-out position to the stored position, the actuator pusher 110J of the first guide member 110 pushes forward the actuator 70. Thus, the actuator 70 (70A) is held at the first standby position.

In contrast, as shown in FIG. 5, when the retransport unit 100 moves from the stored position to the pulled-out position, the actuator pusher 110J of the first guide member 110 moves rearward away from actuator 70, and the actuator 70 pivots upstream in the transport direction D1 from the first standby position. Thus, the actuator 70 (70B) is held at the second standby position.

As shown in FIGS. 2 and 5, a pivot shaft 70S of the actuator 70 extends in the left-right direction such that its left end is exposed from the left side of the second guide member 210. The left end of the pivot shaft 70S includes a detected portion 70Q. The detected portion 70Q is a plate piece protruding radially about the pivot axis X70 in the same direction as the actuator 70 protrudes.

As schematically shown in FIG. 2, a photo-interrupter 70U is disposed at the left side frame 90L at a position corresponding to the detected portion 70Q. When the detected portion 70Q blocks a light path from a light emitter to a light receiver, the photo-interrupter 70U detects that the actuator 70 is at the first standby position and transmits an ON signal to the controller C1. When the detected portion 70Q unblocks a light path from the light emitter to the light receiver, the photo-interrupter 70U detects that the actuator 70 is not at the first standby position and transmits an OFF signal to the controller C1.

In a state in which the drive source M1 is inactive, the controller C1 determines that the retransport unit 100 is at the stored position upon receipt of an ON signal from the photo-interrupter 70U and determines that the retransport unit 100 is not at the stored position upon receipt of an OFF signal from the photo-interrupter 70U.

In a state in which the drive source M1 is active, the controller C1 determines, upon receipt of an ON signal from the photo-interrupter 70U, that the actuator 70 is at the first standby position and that no sheet SH is present on the second transport surface 210G, and determines, upon receipt of an OFF signal from the photo-interrupter 70U, that the actuator is at the passage allowing position and that a sheet SH is present on the second transport surface 210G.

In short, the actuator 70 is used for detection of the presence and absence of a sheet SH on the second transport surface 210G, as well as the position of the retransport unit 100.

The image forming apparatus 1 may simultaneously process a plurality of sheets SH to improve throughput in duplex mode for forming images on both sides of a sheet SH. In an example, a sheet SH may be caused to wait in the middle of the retransport path P2 to allow a next sheet SH to be transported to the image forming unit 3. In this case, the controller C1 causes a sheet SH to wait in the middle of the retransport path P2 on the basis of the position of the actuator 70 for detecting whether a sheet SH is present on the second transport surface 210G.

Action of Skew Roller and Reference Guide on Retransported Sheet

FIG. 8 shows a state of a sheet SH (SHa) transported further in the transport direction D1 after the sheet SH (SHa) is nipped by the first transport roller pair 11 and 11P and the skew roller pair 13 and 13P. In this state, the sheet SH (SHa), whose trailing edge is spaced from the first transport roller pair 11 and 11P, starts being transported by the skew roller pair 13 and 13P alone. A sheet SH being transported by the skew roller pair 13 and 13P alone indicates a state in which a sheet SH is transported by the skew roller pair 13 and 13P alone, with its trailing edge located downstream of the first transport roller pair 11 and 11P and its leading edge located upstream of the second transport roller pair 12 and 12P in the transport direction D1. The sheet SH (SHa) shown in FIG. 8 by way of example is misaligned in the width direction and skewed relative to the centerline LC1.

The skew roller pair 13 and 13P transports the sheet SH (SHa) in such a state toward the reference wall 32 of the reference guide 30. This causes a left edge of the sheet SH (SH a) to contact the front end of the side wall 118A of the side chute 118, while being skewed relative to the left reference line LL1.

The skew roller pair 13 and 13P turns, the sheet SH (SHa) on the first transport surface 110G, clockwise in FIG. 8 about the front end of the side wall 118A. Consequently, as shown in FIG. 8, the left edge of the sheet SH (SHa) follows along the reference wall 32 of the reference guide 30.

In this way, the retransport assembly 10 properly restricts the position of the sheet SH in the width direction such that the left edge of the sheet SH (SHb) is aligned with the left reference line LL1 and a center of the sheet SH (SHb) in the width direction is aligned with the centerline LC1.

In addition, when the skew roller pair 13 and 13P alone transports the sheet SH (SHb) in the transport direction D1, the actuator 70 (70A) at the first standby position is pushed by the sheet SH (SHb) to pivot to the passage allowing position. Consequently, the controller C1 determines that the sheet SH is present on the second transport surface 210G and uses this determination for various timing controls.

As shown in FIG. 8, the sheet SH (SHc), when nipped by the skew roller pair 13 and 13P and the second transport roller pair 12 and 12P, is less likely to change in orientation and is transported further toward the third retransport pass portion P23.

Effects

In the image forming apparatus 1 according to the above-described embodiment, as shown in FIG. 8, the actuator 70 is disposed at the retransport assembly 10 at a position between a center and an end of the second transport surface 210G in the width direction, namely between the centerline LC1 and the left reference line LL1 on the second transport surface 210G.

Thus, when a sheet SH (SHb) is nipped and transported in the transport direction D1 by the skew roller pair 13 and 13P alone to press the actuator 70, a reaction force R1 from the actuator 70 acts on the sheet SH at a position relatively close to the reference wall 32 of the reference guide 30 in the width direction. This may reduce the influence of the reaction force R1 on the sheet SH rotating clockwise in FIG. 8 to follow the reference wall 32 of the reference guide 30. Upon receipt of the reaction force R1, the sheet SH skewed to follow the reference wall 32 is restricted from rotating counterclockwise in FIG. 8.

Thus, at the retransport assembly 10 of the above-described image forming apparatus 1, the actuator 70 is less likely to improperly impede the sheet SH from rotating to follow the reference wall 32 of the reference guide 30. Accordingly, the position of the sheet SH in the width direction is properly restricted.

In the above-described image forming apparatus 1 in which the first imaginary line K1, the second imaginary line K2, and the third imaginary line K3 are defined, the actuator 70 is disposed between the third imaginary line K3 and the left reference line LL1. Furthermore, the actuator 70 is disposed between the first imaginary line K1 and the left reference line LL1. With this structure, when the sheet SH pushes the actuator 70, the reaction force R1 from the actuator 70 acts on the sheet SH at a position closer to the reference wall 32 of the reference guide 30 in the width direction. This may further reduce the influence of the reaction force R1 on the sheet SH skewed to follow the reference wall 32 of the reference guide 30. Upon receipt of the reaction force R1, the sheet SH skewed to follow the reference wall 32 is further restricted from rotating counterclockwise in FIG. 8. Consequently, the actuator 70 is further less likely to improperly impede the sheet SH from rotating to follow the reference wall 32 of the reference guide 30.

In the above-described image forming apparatus 1, the actuator 70 is disposed downstream of the guide end 32E of the reference wall 32 of the reference guide 30 in the transport direction D1. With this structure, when the sheet SH pushes the actuator 70, the reaction force R1 from the actuator 70 acts on the sheet SH at a position relatively greatly spaced downstream from the skew roller 13P, which is disposed upstream of the guide end 32E in the transport direction D1. This may reduce the influence of the reaction force R1 on the sheet SH skewed to follow the reference wall 32 of the reference guide 30. Consequently, the actuator 70 is further less likely to improperly impede the sheet SH from rotating to follow the reference wall 32 of the reference guide 30.

In the above-described image forming apparatus 1, the skew roller 13P is disposed between a center and an end of the first transport surface 110G in the width direction, namely between the centerline LC1 and the left reference line LL1 on the first transport surface 110G. With this structure, a drive force of the skew roller 13P transporting the sheet SH in a skewed manner acts on the sheet SH at a position relatively close to the reference wall 32 of the reference guide 30 in the width direction. Thus, the sheet SH quickly follows the reference wall 32 of the reference guide 30, while the location of the actuator 70 favorably affects the sheet SH, as described above.

In the above-described image forming apparatus 1, as shown in FIG. 7, the actuator 70 at the passage allowing position overlaps the roller portions 12A when viewed in the width direction. With this structure, when the sheet SH pushes the actuator 70 disposed relatively close to the rotation shaft 12S of the second transport rollers 12, the reaction force R1 from the actuator 70 acts on the sheet SH at a position relatively greatly spaced downstream from the skew roller 13P. This may reduce the influence of the reaction force R1 on the sheet SH skewed to follow the reference wall 32 of the reference guide 30. Consequently, the actuator 70 is further less likely to improperly impede the sheet SH from rotating to follow the reference wall 32 of the reference guide 30.

In the above-described image forming apparatus 1, as shown in FIG. 3, when the retransport unit 100 is moved to the pulled-out position, the actuator 70 remains in the main body 2 and thus is less likely to be broken. Regardless of movement of the retransport unit 100, as shown in FIG. 2, a positional relation between the detected portion 70Q of the actuator 70 disposed at the connecting unit 200 and the photo-interrupter 70U disposed at the main body 2 may be constantly maintained, thereby ensuring an accurate detection of a sheet SH.

In the above-described image forming apparatus 1, as shown in FIG. 7, when the retransport unit 100 moves from the pulled-out position to the stored position, the actuator 70 is held at the first standby position shown by reference character 70A. When the actuator 70 moves from the stored position to the pulled-out position, the actuator 70 pivots, due to the urging force of the torsion coil spring 70T, upstream in the transport direction D1 from the first standby position to the second standby position, and is held at the second standby position shown by reference character 70B. When pressed by a sheet SH passing on or over the second transport surface 210G, the actuator 70 pivots from the first standby position to the passage allowing position. This structure allows, in a state in which the drive source M1 is inactive, the controller C1 to determine that the retransport unit 100 is at the pulled-out position upon receipt of an OFF signal from the photo-interrupter 70U with its light path unblocked by the detected portion 70Q of the actuator 70. In short, the actuator 70 is used for detection of the presence and absence of a sheet SH, as well as the position of the retransport unit 100. Consequently, reduction in the number of components and downsizing may be achieved in the image forming apparatus 1.

In the above-described image forming apparatus 1, as shown in FIG. 7, the upper end of the actuator 70 (70A) at the first standby position is positioned above the guide surface 220G. This structure allows the actuator 70 to reliably contact a sheet SH passing between the second transport surface 210G and the guide surface 220G of the connecting unit 200 such that the actuator 70 reliably detects the sheet SH.

While the disclosure has been described with reference to a particular embodiment, various changes, arrangements and modifications may be applied therein without departing from the spirit and scope of the disclosure.

What is claimed is:

1. A sheet transport device comprising:

a transport guide configured to guide, along a transport surface thereof, a sheet in a transport direction;

a first transport roller pair disposed at the transport guide;

a second transport roller pair disposed at the transport guide at a position downstream of the first transport roller pair in the transport direction;

a single skew roller pair, which is the only skew roller pair disposed at the transport guide at a position downstream of the first transport roller pair and upstream of the second transport roller pair in the transport direction, configured to alone transport the sheet in a skewed manner toward an end of the transport surface in a width direction orthogonal to the transport direction, wherein the sheet is spaced from the first transport roller pair and the second transport roller pair while being transported by the single skew roller pair;

a reference wall positioned at the end of the transport surface in the width direction and extending along the transport direction; and an actuator disposed downstream of the single skew roller pair and upstream of the second transport roller pair in the transport direction and between the end and a center of the transport surface in the width direction, wherein the single skew roller pair includes a skew roller rotatable about a skew axis inclined relative to the width direction, wherein the sheet transport device defines:

a first imaginary line passing through a midpoint of the skew roller in a direction of the skew axis and extending in the transport direction;

a second imaginary line passing through the midpoint of the skew roller and extending orthogonally to the skew axis, and deviating toward the end of the transport surface in the width direction as the second imaginary line extends in the transport direction; and a third imaginary line symmetric to the second imaginary line relative to the first imaginary line, and wherein the actuator is disposed between the third imaginary line and the end of the transport surface in the width direction.

2. The sheet transport device according to claim 1, wherein the actuator is disposed between the first imaginary line and the end of the transport surface in the width direction.

3. The sheet transport device according to claim 1, wherein the reference wall has, at a downstream end thereof in the transport direction, a guide end located downstream of the single skew roller pair and upstream of the second transport roller pair in the transport direction, and wherein the actuator is disposed downstream of the guide end in the transport direction.

4. The sheet transport device according to claim 1, wherein the single skew roller pair is disposed between the center and the end of the transport surface in the width direction.

5. A sheet transport device comprising:

a transport guide configured to guide, along a transport surface thereof, a sheet in a transport direction;

a first transport roller pair disposed at the transport guide;

a second transport roller pair disposed at the transport guide at a position downstream of the first transport roller pair in the transport direction;

a single skew roller pair, which is the only skew roller pair disposed at the transport guide at a position downstream of the first transport roller pair and upstream of the second transport roller pair in the transport direction, configured to alone transport the sheet in a skewed manner toward an end of the transport surface in a width direction orthogonal to the transport direction, wherein the sheet is spaced from the first transport roller pair and the second transport roller pair while being transported by the single skew roller pair;

a reference wall positioned at the end of the transport surface in the width direction and extending along the transport direction; and an actuator disposed downstream of the single skew roller pair and upstream of the second transport roller pair in the transport direction and between the end and a center of the transport surface in the width direction, wherein the second transport roller pair includes a second transport roller, the second transport roller including a rotation shaft, and a roller portion fixed to the rotation shaft and rotatable integrally with the rotation shaft, wherein the actuator is movable between a first standby position to protrude beyond the transport surface and a passage allowing position to allow passage of the sheet, and wherein the actuator, when located at the passage allowing position, overlaps the roller portion of the second transport roller when viewed in the width direction.

6. An image forming apparatus comprising:

a main body;

an image forming unit disposed inside the main body;

a sheet tray disposed inside the main body at a position below the image forming unit and configured to store therein sheets to be fed to the image forming unit; and a retransport assembly disposed inside the main body and configured to transport a sheet having an image formed on one side thereof by the image forming unit back to the image forming unit, the retransport assembly including a sheet transport device, wherein the sheet transport device includes:

a transport guide configured to guide, along a transport surface thereof, a sheet in a transport direction;

a first transport roller pair disposed at the transport guide;

a second transport roller pair disposed at the transport guide at a position downstream of the first transport roller pair in the transport direction;

a single skew roller pair, which is the only skew roller pair disposed at the transport guide at a position downstream of the first transport roller pair and upstream of the second transport roller pair in the transport direction, configured to alone transport the sheet in a skewed manner toward an end of the transport surface in a width direction orthogonal to the transport direction, wherein the sheet is spaced from the first transport roller pair and the second transport roller pair while being transported by the single skew roller pair;

a reference wall positioned at the end of the transport surface in the width direction and extending along the transport direction;

an actuator disposed downstream of the single skew roller pair and upstream of the second transport roller pair in the transport direction and between the end and a center of the transport surface in the width direction;

a first unit movable between a stored position to be stored inside the main body at a position below the sheet tray, and a pulled-out position to be pulled out from the stored position; and a second unit supported, by the main body, inside the main body at a position below the sheet tray and adjacent to the first unit in a substantially horizontal direction, and wherein the first unit includes a portion of the transport guide, the reference wall, and the single skew roller pair, and the second unit includes another portion of the transport guide, the second transport roller pair, and the actuator.

7. The image forming apparatus according to claim 6, wherein the second unit includes an urging member configured to exert an urging force that urges the actuator upstream in the transport direction, and wherein the actuator is configured to:

when the first unit moves from the pulled-out position to the stored position, be held at a first standby position to protrude beyond the transport surface, and when the first unit moves from the stored position to the pulled-out position, move from the first standby position, due to the urging force, upstream in the transport direction and to be held at a second standby position.

8. The image forming apparatus according to claim 7, wherein the second unit includes, as the other portion of the transport guide:

a guide member configured to guide the sheet from below, and a facing member facing down toward the guide member and having a guide surface configured to guide the sheet from above, and wherein an upper end of the actuator at the first standby position is located above the guide surface.

* * * * *